US009226588B2

(12) United States Patent
McCarty et al.

(10) Patent No.: US 9,226,588 B2
(45) Date of Patent: Jan. 5, 2016

(54) KNOCKDOWN BED

(71) Applicants: RUOEY LUNG ENTERPRISE CORP., Lu-Kang Town, Changhua County (TW); PPJ. LLC, Natick, MA (US)

(72) Inventors: Philip Woods McCarty, Natick, MA (US); Philip Reid Sherman, Melville, NY (US); Chuan-Hang Shih, Lu-Kang Town, Changhua County (TW)

(73) Assignees: RUOEY LUNG ENTERPRISE CORP., Lu-Kang Town, Changhua County (TW); PPJ. LLC, Natick, MA (US)

( * ) Notice: Subject to any disclaimer, the term of this patent is extended or adjusted under 35 U.S.C. 154(b) by 244 days.

(21) Appl. No.: 13/826,329

(22) Filed: Mar. 14, 2013

(65) Prior Publication Data

US 2014/0259396 A1 Sep. 18, 2014

(51) Int. Cl.
*A47C 19/00* (2006.01)
*A47C 19/02* (2006.01)

(52) U.S. Cl.
CPC ..... *A47C 19/005* (2013.01); *A47C 19/028* (2013.01)

(58) Field of Classification Search
CPC .... A47C 19/005; A47C 19/028; A47C 19/12; A47C 19/122; A47C 19/124; A47C 19/126; F16B 12/54; F16B 12/56; F16B 12/58; A61G 13/105; A61G 1/013
See application file for complete search history.

(56) References Cited

U.S. PATENT DOCUMENTS

| | | | | | |
|---|---|---|---|---|---|
| 1,826,421 | A * | 10/1931 | Butkus | 5/288 |
| 2,962,170 | A * | 11/1960 | Best | 211/182 |
| 5,522,101 | A * | 6/1996 | Yeh | 5/9.1 |
| 5,694,656 | A * | 12/1997 | Huang | 5/290 |
| 7,690,058 | B1 * | 4/2010 | Dwyer et al. | 5/310 |
| 8,136,183 | B1 * | 3/2012 | Jannetides | 5/282.1 |
| 2008/0222801 | A1 * | 9/2008 | Harrow | 5/1 |
| 2009/0300840 | A1 * | 12/2009 | Polevoy et al. | 5/200.1 |
| 2010/0242171 | A1 * | 9/2010 | Polevoy et al. | 5/282.1 |

* cited by examiner

*Primary Examiner* — David E Sosnowski
(74) *Attorney, Agent, or Firm* — Muncy, Geissler, Olds & Lowe, P.C.

(57) ABSTRACT

A knockdown bed is formed of a first bed frame and a second bed frame. The first bed frame includes a top side, a bottom side, and an insertion member. The insertion member has an insertion end, a fixed end connected with the bottom side, two lateral sides, and two abutment surfaces connected with the two lateral sides. The two abutment surfaces gradually approach each other from the fixed end to the insertion end. The second bed frame includes a top side, a bottom side, and a slot member adjacent to the first bed frame. The slot member is formed of two sidewalls, two abutment walls connected with the two sidewalls, and a slot, into which the insertion member can be inserted to interconnect the first and second bed frames. In this way, the knockdown bed can be easily assembled and structurally firm.

5 Claims, 4 Drawing Sheets

KNOCKDOWN BED

BACKGROUND OF THE INVENTION

1. Field of the Invention

The present invention relates generally to a knockdown bed and more particularly, to a highly convenient and highly stable knockdown bed.

2. Description of the Related Art

Most of the conventional beds are one-piece and large and heavy, especially the power-assisted beds containing built-in electric motors, so it is difficult to move such beds. Besides, the doors of the contemporary apartments are relatively narrower and smaller, so it may even need to entrust the mover with moving the beds into the house through French windows by means of the crane. If a user does not need to use the bed for the time being, it will be a problem for him or her to keep it for storage. For this reason, a knockdown bed was invented. The parts of the general knockdown bed are connected by means of screw holes and bolts. However, after the knockdown bed is used for a long time, the screw holes and the bolts are subject to disengagement from each other. In addition, while it is intended to dismantle the bed, a tool is needed, so it is not only time-consuming but inconvenient for the user to do it.

SUMMARY OF THE INVENTION

The primary objective of the present invention is to provide a knockdown bed, which can be easily assembled and structurally firm.

The foregoing objective of the present invention is attained by the knockdown bed formed of a first bed frame and a second bed frame. The first bed frame includes a top side, a bottom side, and an insertion member. The insertion member has an insertion end, a fixed end connected with the bottom side, two lateral sides, and two abutment surfaces connected with the two lateral sides. The two abutment surfaces gradually approach each other from the fixed end to the insertion end. The second bed frame includes a top side, a bottom side, and a slot member adjacent to the first bed frame. The slot member is formed of two sidewalls, two abutment walls connected with the two sidewalls, and a slot defined among the two sidewalls and the two abutment walls. The insertion member can be inserted into the slot member to interconnect the first and second bed frames.

DETAILED DESCRIPTION OF PREFERRED EMBODIMENTS

Figure 1:
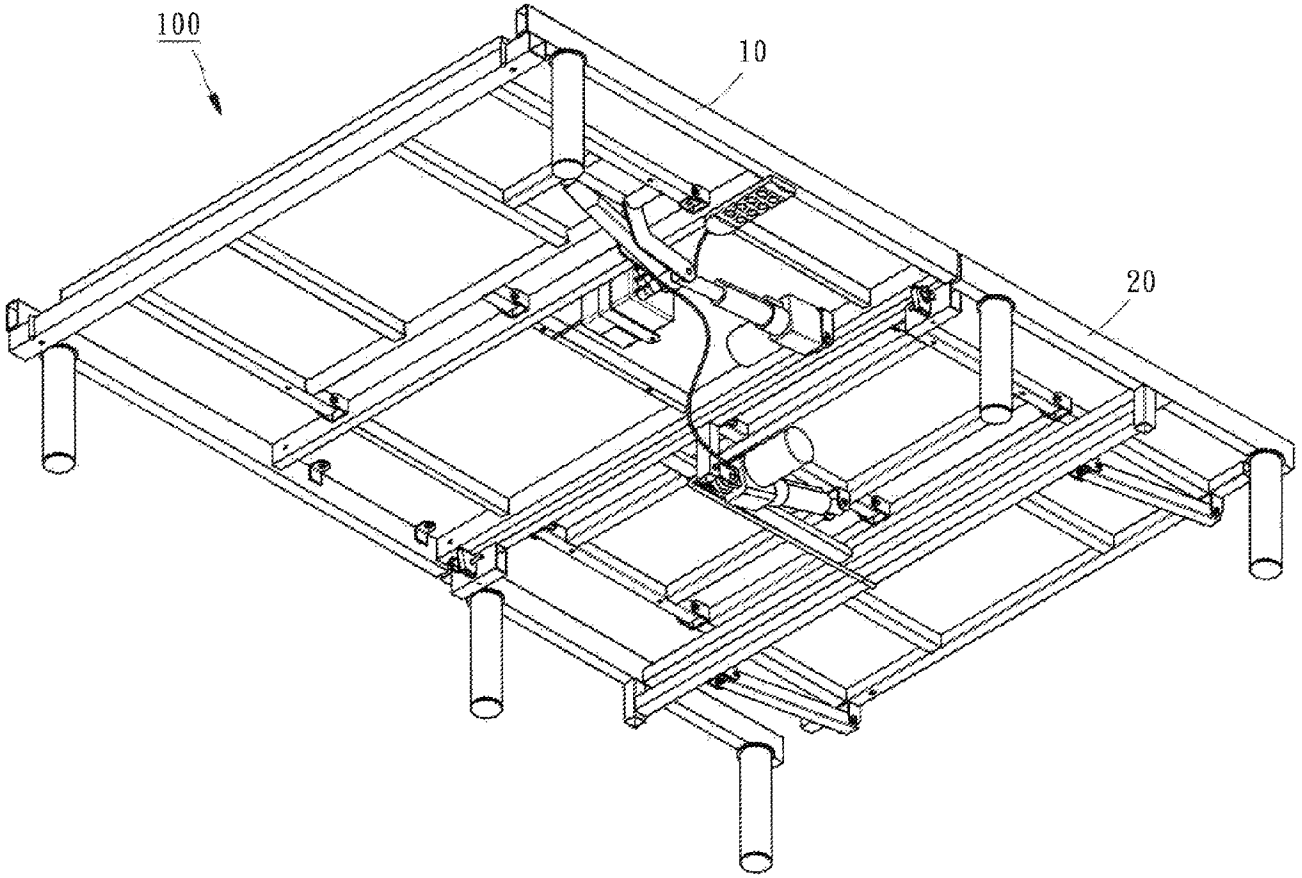
FIG. 1 is a perspective view of a preferred embodiment of the present invention.

Structural features and desired effects of the present invention will become more fully understood by reference to a preferred embodiment given hereunder. However, it is to be understood that the embodiment is given by way of illustration only, thus is not limitative of the claim scope of the present invention.

Referring to FIGS. 1-4, a knockdown bed 100 constructed according to a preferred embodiment of the present invention is formed of a first bed frame 10 and a second bed frame 20. The detailed descriptions and operations of these elements as well as their interrelations are recited in the respective paragraphs as follows.

Referring to FIG. 2 again, the first bed frame 10 includes a top side 12, a bottom side 14, and two insertion members 16. Each of the insertion members 16 is vertically fixed to the bottom side 14 and close to the second bed frame 20, having an insertion end 165 formed at a lower side thereof and a fixed end formed at an upper side thereof and connected with the bottom side 14. As shown in FIG. 3, each of the insertion members 16 includes two lateral sides 161 and two abutment surfaces 163 connected with the two lateral sides 161. Each of the lateral sides 161 is trapezoid where the two abutment surfaces 163 gradually approach each other from the fixed end 167 to the insertion end 165. In this embodiment, the abutment surface 163 at the right side shown in FIG. 3 is substantially perpendicular to the bottom side 14 of the first bed frame 10. However, an included angle between the two abutment surfaces 163 may differ from the included angle illustrated in this preferred embodiment as long as it fulfills the condition that the two abutment surfaces 163 gradually approach each other from the fixed end 167 to the insertion send 165.

Figure 2:
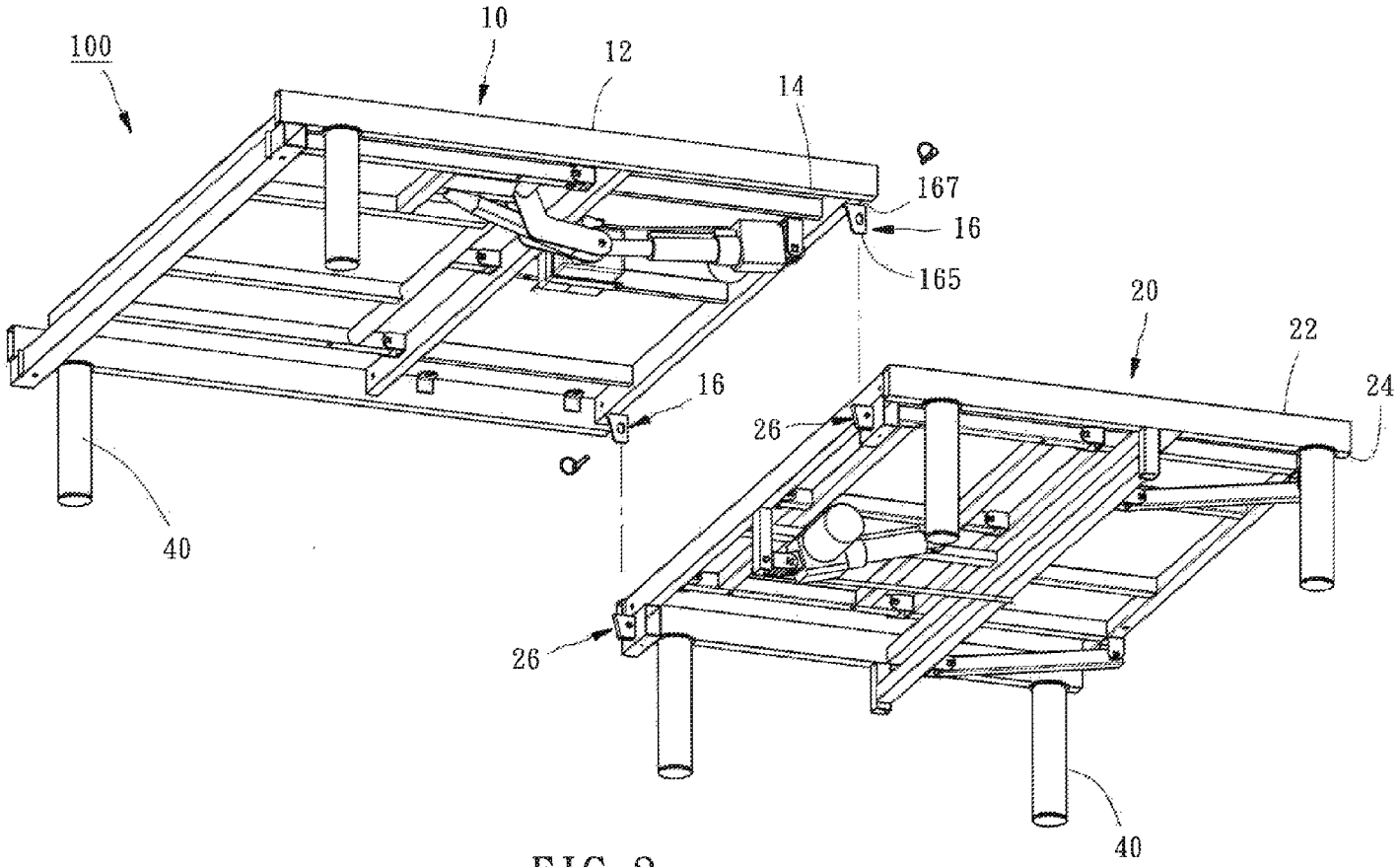
FIG. 2 is an exploded view of major parts of the preferred embodiment of the present invention.
Figure 3:
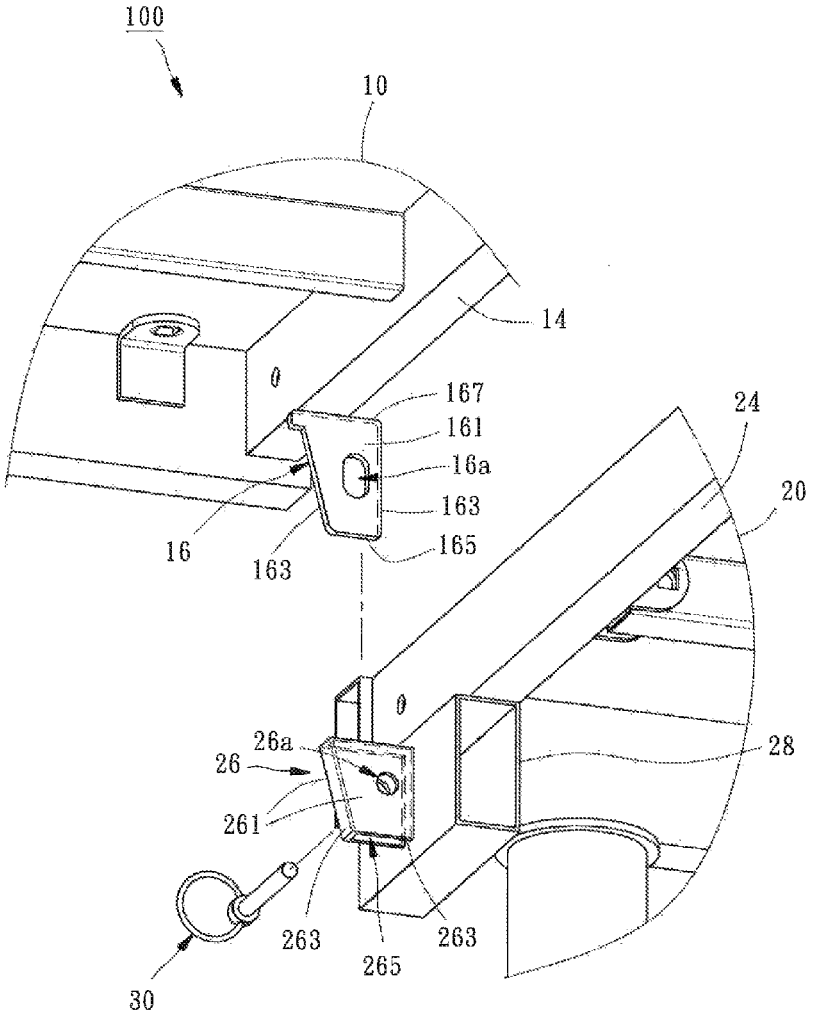
FIG. 3 is a partially exploded view of the preferred embodiment of the present invention.

As shown in FIG. 2, the second bed frame 20 includes a top side 22, a bottom side 24, and two slot members 26 mounted to the bottom side 24 of the second bed frame 20 and extending outward from the bottom side 24 of the second bed frame 20 toward the first bed frame 10. It is to be understood that the slot members 26 can be set in any desired location according to a design requirement. As shown in FIG. 3, each of the slot members includes two sidewalls 261, two abutment walls 263 connected with the two sidewalls 261, and a slot 265 defined among the sidewalls 261 and the two abutment walls 263 for insertion of the insertion member 16. In this embodiment, the two sidewalls 261 are also trapezoid and parallel to each other, so the two abutment walls 263 gradually approach each other from top to bottom to match the two abutment surfaces 163. In this way, the slot 265 is complementary to the insertion member 16 in size and shape, such that the insertion member 16 can be inserted into the slot 265 tightly.

Referring to FIG. 3 again, the knockdown bed 100 further includes two mounting members 28 mounted to the bottom side of the second bed frame. The two slot members 26 protrude outward from the mounting members 28 toward the first bed frame 10, respectively. However, the mounting members 28 are not any of the essential features of the present invention, so they can be omitted as it depends.

When it is intended to assemble the knockdown bed 100, the user can put the two insertion members 16 of the first bed frame 10 into the two slot members 26 of the second bed frame 20, respectively. Because the insertion members 16 and the slot members 26 are all trapezoid to be increasingly narrow from top to bottom, when the insertion members 16 are inserted into the slot members 26 respectively, the weight of the first bed frame 10 can make the insertion members 16 and the slot members 26 be interconnected firmly to further interconnect the first and second bed frames 10 and 20 firmly. In the process of the assembly, none of any tool is needed to screw on any screw bolt, so it is very simple and convenient for the user to do so. Besides, when the user needs to move or keep the knockdown bed 100 for storage, the user only needs to uplift the first bed frame 10 to disengage the insertion members 16 from the slot members 26 respectively to further separate the first and second bed frames 10 and 20 from each other. Thus, it is very convenient for moving or keeping the knockdown bed for storage.

By the way, the insertion member 16 and the slot member 26 are structurally complementary to each other, so when the insertion members 16 are inserted into the slot members 26 via the insertion ends 165, the two abutment surfaces 163 tightly abut against the two abutment walls 263 to firmly interconnect the insertion members 16 and the slot members 26. After the insertion members 16 and the slot members 26 are interconnected, the top side 12 of the first bed frame 10 is flush with the top side 22 of the second bed frame 20 to become a flat bed surface.

Figure 4:
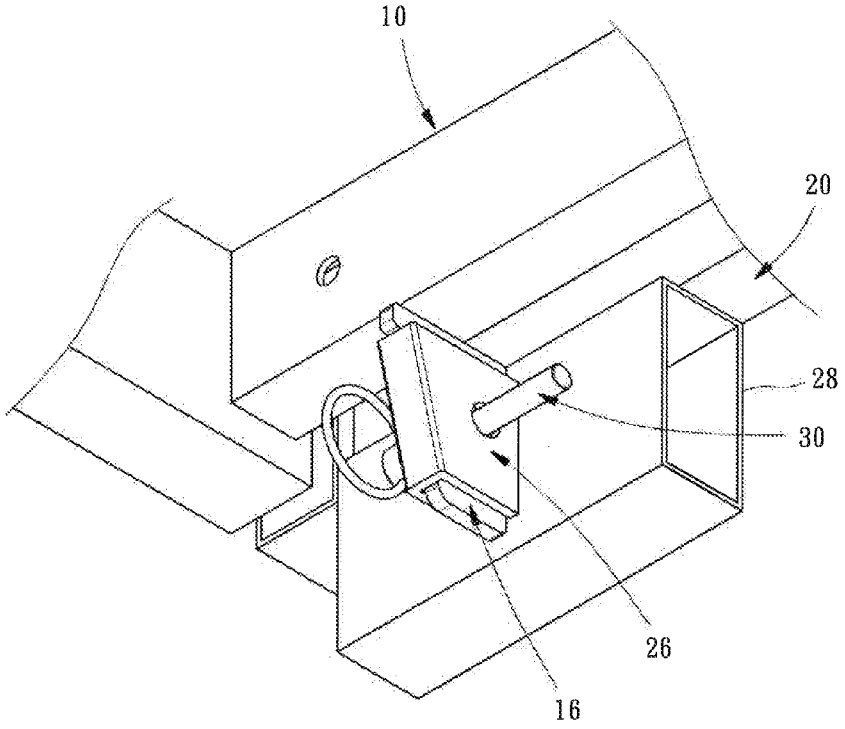
FIG. 4 is a partially perspective view of the preferred embodiment of the present invention.

In addition, to prevent the user from accidentally uplifting the first bed frame 10 to disengage it from the second bed frame 20, as shown in FIGS. 3 and 4, each of the insertion members 16 further includes a first plug hole 16*a* and each of the sidewalls 261 includes a second plug hole 26*a* correspondsively aligned with the first plug hole 16*a* when the insertion members 16 are inserted into the slot members 26. A plug 30 can be inserted through the first and second plug holes 16*a* and 26*a* to much firmly interconnect the insertion members 16 and the slot members 26. When it is intended to dismantle the knockdown bed 100, it is necessary to remove the plug 30 before the first and second bed frames 10 and 20 can be separated.

To prevent the first plug hole 16*a* and the second plug hole 26 from misalignment resulting from processing tolerance and prevent the plug 30 from uneasy insertion into the first and second plug holes 16*a* and 26*a*, as shown in FIG. 3, the first plug hole 16*a* can be made to be slightly larger than the second plug hole 26*a*, so in this way, the plug 30 can be easily inserted through the first and second plug holes 16*a* and 26*a*. Instead, the second plug hole 26*a* can be made to be slightly larger than the first plug hole 16*a* to reach the same effect. However, the sizes of such plug and plug holes are not any essential feature of the present invention, so they are changeable as it depends.

When the knockdown bed 100 is additionally provided with bed legs for boost its height, the first bed frame 10 already has had the insertion members 16 located at two corners thereof to be supported by the two slot members 26, so only one bed leg is necessary to be mounted to either of other positions or corners of the first bed frame 10, and the first bed frame 10 can be firmly supported by the two insertion members 16, which are in turn supported by the slot members 26 of the second bed frame 20, and the additional bed leg 40. The second bed frame 20 needs to support a part of the first bed frame 10 in weight, so at least three bed legs are necessary to firmly support the second bed frame 20. As shown in FIG. 2, in this embodiment, two of the bed legs 40 are mounted to the first bed frame 10 and four of the bed legs 40 are mounted to the second bed frame 20, and in this way, the knockdown bed 100 can be more firm to avoid overset.

It is worth mentioning that the locations of the insertion members and the slot members are interchangeable. In other words, the insertion members are mounted to the second bed frame with the insertion end protruding upward and the slot members are mounted to the first bed frame with the opening of the slot facing downward for insertion of the insertion members to reach the same purpose of the present invention.

What is claimed is:

1. A knockdown bed comprising:

a first bed frame having a top side, a bottom side, and a trapezoidal insertion member having an insertion end, a fixed end connected with the bottom side, two lateral sides, and two abutment surfaces connected with the two lateral sides in a way that distances between the two abutment surfaces taper from the fixed end toward the insertion end;

a second bed frame having a top side, a bottom side, and a trapezoidal slot member having two sidewalls, two abutment walls connected with the two sidewalls, a slot defined among the two sidewalls and the abutment walls, the insertion member being detachably inserted into and through the slot of the slot member such that when inserted a bottommost surface of the insertion member extends below a bottommost surface of the slot member;

wherein a top side of one of the abutment surfaces of the insertion member comprises a flange extending longitudinally with respect to the first and second bed frames and which rests upon a top surface of one of the abutment walls when the insertion member is inserted into the slot member;

wherein the insertion member is detachably inserted into the slot of the slot member in a way that the top side of the first bed frame is substantially flush with the top side of the second bed frame; and wherein the insertion member comprises a first plug hole and each of the sidewalls of the slot member comprises a second plug hole, the second plug holes being aligned with the first plug hole when the insertion member is inserted into the slot; and a plug insertable through the first and second plug holes, wherein the first plug hole is an elongated ovoid hole and the second plug holes are round holes, the first plug hole being larger than each of the second plug holes.

2. The knockdown bed as defined in claim 1, wherein the insertion member is detachably inserted into the slot of the slot member in a way that the two abutment surfaces of the insertion member tightly abut against the two abutment walls of the slot member.

3. The knockdown bed as defined in claim 1, wherein the first bed frame comprises a second insertion member identical to and spaced from said insertion member, and the knockdown bed further comprises at least one bed leg mounted to the bottom side of the first bed frame.

4. The knockdown bed as defined in claim 1, further comprising at least three bed legs mounted to the bottom side of the second bed frame.

5. The knockdown bed as defined in claim 1, wherein one of the abutment surfaces of the insertion member is substantially perpendicular to the bottom side of the first bed frame.

* * * * *